United States Patent [19]

Reiniche et al.

[11] Patent Number: 4,983,227

[45] Date of Patent: Jan. 8, 1991

[54] PROCESS AND APPARATUS FOR HEAT-TREATING CARBON STEEL WIRES TO OBTAIN A FINE PEARLITIC STRUCTURE

[75] Inventors: Andre Reiniche, Clermont-Ferrand; Philippe Sauvage, Chateaugay, both of France

[73] Assignee: Compagnie Generale Des Etablissements Michelin-Michelin & Cie, Clermont-Ferrand Cedex, France

[21] Appl. No.: 299,257

[22] Filed: Jan. 23, 1989

[30] Foreign Application Priority Data

Jan. 25, 1988 [FR] France ..... 88 00904

[51] Int. Cl.[5] ..... C21D 9/573; C21D 9/63; C21D 1/613

[52] U.S. Cl. ..... 148/128; 148/156; 266/103; 266/111; 266/110

[58] Field of Search ..... 148/128, 12 B, 14, 153, 148/154, 156; 266/103, 111, 110, 112

[56] References Cited

U.S. PATENT DOCUMENTS

| | | | |
|---|---|---|---|
| 4,581,512 | 4/1986 | McGinn et al. | 165/75 |
| 4,786,338 | 11/1988 | Anzawa et al. | 148/128 |
| 4,830,684 | 5/1989 | Reiniche | 148/128 |

FOREIGN PATENT DOCUMENTS

| | | | |
|---|---|---|---|
| 52-47508 | 4/1977 | Japan | 266/110 |
| 61-170520 | 8/1986 | Japan | 266/111 |
| 3630487 | 3/1988 | Japan | 266/110 |

*Primary Examiner*—Deborah Yee

*Attorney, Agent, or Firm*—Brumbaugh, Graves, Donohue & Raymond

[57] ABSTRACT

Carbon steel wire, which has been maintained at a temperature above the Ac3 transformation temperature, is heat-treated to obtain a fine pearlitic structure by passing it through a tube containing a gas practically without forced ventilation and surrounded by a heat-exchange fluid. Certain relationships between the diameter of the wire, the diameter of the tube and the conductivity of the gas are to be satisfied to ensure cooling of the wire to a temperature below the Acl transformation temperature in a time prior to the time of the pearlitic nose and to effect pearlitization to completion under a nearly isothermal state.

10 Claims, 6 Drawing Sheets

1
7
6
200
4
3
x
y 10
5
9
4
3
6
2
1
x
x'
Dmi
Dme
y
y'
F3
12
V
Df
Dti
Dte
7
Lt
Lm
11
200

PROCESS AND APPARATUS FOR HEAT-TREATING CARBON STEEL WIRES TO OBTAIN A FINE PEARLITIC STRUCTURE

FIELD OF THE INVENTION

The present invention concerns processes and devices for the heat treatment of carbon steel wires so as to obtain a fine pearlitic structure. These wires are used, in particular, to reinforce articles of rubber and/or plastic, for instance pneumatic tires.

The object of these heat treatments is, on the one hand, to increase the suitability for wire drawing of the wires and, on the other hand, to improve their mechanical properties and their life.

BACKGROUND OF THE INVENTION

The known treatments of this type comprise two phases:

- a first phase which consists in heating the wire and holding it at a temperature above the Ac3 transformation temperature so as to obtain a homogeneous austenite;
- a second phase which consists in cooling the wire in order to obtain a fine pearlitic structure.

One of the most generally used processes is a heat treatment known as "patenting", which consists of an austenitization of the wire at a temperature of 900° to 1000° C. followed by immersion in a bath of lead or molten salts held at a temperature of 450° to 600° C.

The good results obtained, particularly in the case of heat treatment with lead, are generally attributed to the fact that the very high coefficients of convection which are obtained between the wire and the cooling fluid permit, on the one hand, a rapid cooling of the wire between the Ac3 transformation temperature and a temperature slightly greater than that of the lead and, on the other hand, a limiting of the recalescence during the transformation of the metastable austenite into pearlite, recalescense being an increase in the temperature of the wire due to the fact that the energy contributed by the metallurgical transformation is greater than the energy lost by radiation and convection.

Patenting, unfortunately, involves high costs since the handling of the liquid metals or molten salts requires cumbersome technologies and necessitates cleaning the wire after patenting. Furthermore, lead is very toxic and handling it properly for safety to personnel and the environment is expensive.

French Patent Application No. 86/16705 describes a process for heat treating a carbon steel wire so as to obtain a fine pearlitic structure by regulating the temperature of the wire during the transformation of austenite into pearlite in such a manner that it does not differ by more than 10° C., plus or minus, from a given temperature which is less than the temperature of transformation Ac1 and above the temperature of tne pearlitic nose, this adjustment being obtained by passing an electric current through the wire for a period of time greater than the pearlitization time and effecting a modulated ventilation for a part of this time. This process makes it possible to avoid the use of molten metals or salts and it therefore eliminates the problems of environmentally safe handling and of cleaning the wires while leading to simpler installations of more flexible operation. This process, however, requires the use of compressors or turbines in order to obtain a modulated ventilation, which may lead to relatively high investment and operating expenses. Furthermore, this process can be used on an industrial scale only for wires of relatively small diameter, for instance of at most 3 mm.

SUMMARY OF THE INVENTION

The object of the present invention is to make it possible to carry out a heat treatment for the transformation of austenite into pearlite which avoids the use of molten metals or salts, as well as the use of forced ventilation, while making it possible to treat wires, the diameter of which may vary within wide limits.

Accordingly, the invention concerns a process for heat treating at least one carbon steel wire so as to obtain a fine pearlitic structure, the wire having been maintained prior to this treatment at a temperature greater than the Ac3 transformation temperature so as to obtain a homogeneous austenite. The process is characterized by the following (a) the wire is cooled from a temperature greater than the Ac3 transformation temperature to a temperature less than the Ac1 transformation temperature;

(b) the pearlitization treatment is then carried out at a temperature below the Ac1 transformation temperature;

(c) this cooling and pearlitization treatment is carried out by passing the wire through at least one tube which contains a gas practically without forced ventilation, the tube being surrounded by a heat-exchange fluid in such a manner that a transfer of heat takes place from the wire through the gas in the tube towards the heat-exchange fluid;

(d) the characteristics of the tube, the wire and the gas are so selected that the following relationships are established, at least upon the cooling preceding the pearlitization:

$$1.05 \leqq R \leqq 15 \quad (1)$$

$$5 \leqq K \leqq 10 \quad (2)$$

in which $$R = D_{ti}/D_f$$

$$K = [\mathrm{Log}\,(D_{ti}/D_f)] \times D_f^2/\lambda$$

$D_{ti}$ being the inside diameter of the tube expressed in millimeters, $D_f$ being the diameter of the wire expressed in millimeters, this diameter being not greater than 6 mm, $\lambda$ being the conductivity of the gas determined at 600° C., this conductivity being expressed in watts.m$^{-1}$.$^{o}$K$^{-1}$, and Log being the natural log.

The invention also concerns apparatus which makes it possible to effect the heat treatment of at least one carbon steel wire so as to obtain a fine pearlitic structure, the wire having been held, prior to this treatment, at a temperature above the Ac3 transformation temperature in order to obtain a homogeneous austenite. The apparatus is characterized by the following features:

(a) it comprises means for cooling the wire from a temperature above the Ac3 transformation temperature to a temperature below the Ac1 transformation temperature;

(b) it comprises means which make it possible to effect the pearlitization treatment at a temperature below the Ac1 transformation temperature;

(c) these cooling and pearlitization means comprise at least one tube and means for passing the wire through the tube, said tube containing a gas which is practically without forced ventilation and the tube being surrounded by a heat-exchange fluid in such a manner that a transfer of heat takes place from the wire through the gas and through the tube to the heat-exchange fluid;

(d) the characteristics of the tube, the wire and the gas are so selected that the following relationships exist, at least upon the cooling preceding the pearlitization:

$$1.05 \leqq R \leqq 15 \quad (1)$$

$$5 \leqq K \leqq 10 \quad (2)$$

in which $$R = D_{ti}/D_f$$

$$K = [\mathrm{Log}\,(D_{ti}/D_f)] \times D_f^2/\lambda$$

$D_{ti}$ being the inside diameter of the tube expressed in millimeters, $D_f$ being the diameter of the wire expressed in millimeters, this diameter being not greater than 6 mm, $\lambda$ being the conductivity of the gas determined at 600° C., this conductivity being expressed in watts.m$^{-1}$.°K$^{-1}$, and Log being the natural log.

The expression "practically without forced ventilation" means that the gas in the tube is either immobile or subjected to a slight ventilation which in practice does not modify the heat exchanges between the wire and the gas, this slight ventilation being due, for instance, solely to the movement of the wire itself.

The invention also concerns the processes and complete installations for the heat treatment of carbon steel wires using the processes or devices previously described.

The invention also concerns the steel wires obtained by the processes and/or with the device and installations in accordance with the invention.

The invention will be further understood on the basis of the non-limitative examples which follow and the diagrammatic figures of the drawing relating to these examples.

DESCRIPTION OF THE EMBODIMENTS AND EXAMPLES

Figure 1:
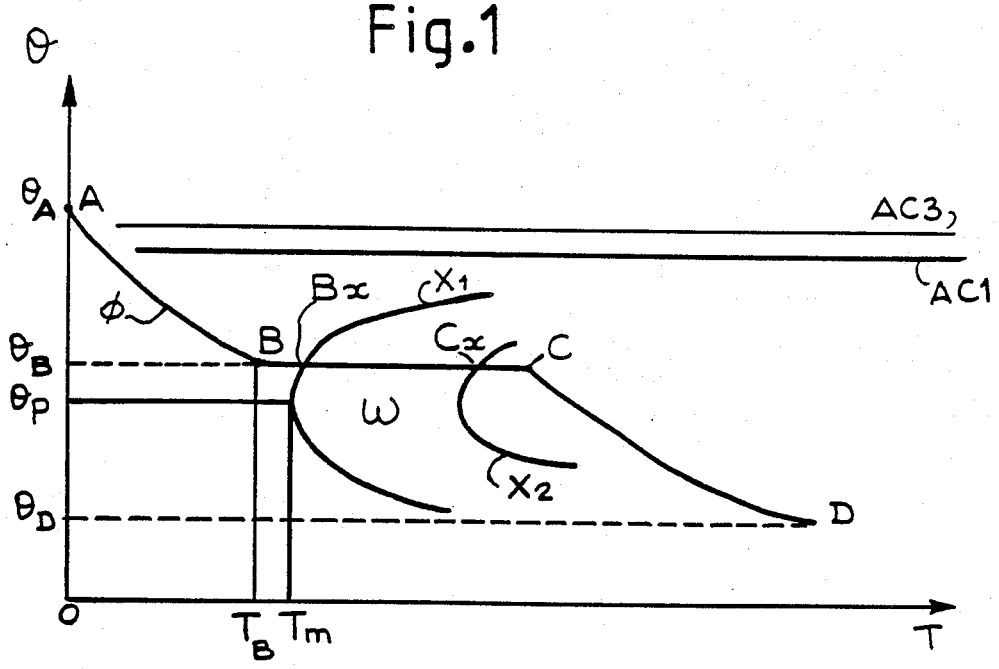
FIG. 1 shows transformation curves of austenite into pearlite as well as a curve showing the variation of the temperature as a function of time for a steel wire treated so as to obtain a fine pearlitic structure.

FIG. 1 shows the curve $\phi$ which represents the change in the temperature of a steel wire as a function of time when this wire is subjected to a pearlitization treatment. This figure also shows the curve $X_1$ corresponding to the start of the transformation of metastable austenite into pearlite and the curve $X_2$ corresponding to the end of the transformation of metastable austenite into pearlite for the steel of this wire. In this FIG. 1., the abscissa axis corresponds to the time T and the ordinate axis corresponds to the temperature $\theta$.

Prior to the pearlitization treatment, the wire has been heated and held at a temperature above the Ac3 transformation temperature so as to obtain a homogeneous austenite, this temperature $\theta_A$, of for instance between 900° C. and 1000° C., corresponding to point A in FIG. 1. The so-called "pearlitic nose" corresponds to the minimum time $T_m$ of the curve $X_1$, the temperature of this pearlitic nose being labeled $\theta_p$. The origin 0 for the time T corresponds to the point A.

The wire is cooled until it reaches a temperature below the Ac1 transformation temperature, the condition of the wire after this cooling corresponding to point B and the temperature obtained at this point B at the end of the time $T_B$ being marked $\theta_B$. This temperature $\theta_B$ has been shown in FIG. 1 as greater than the temperature $\theta_p$ of the pearlitic nose, which is generally the case in practice but is not absolutely necessary. During this cooling of the wire between the points A and B there is a transformation of stable austenite into metastable austenite as soon as the temperature of the wire drops below the Ac3 transformation point, and "seeds" appear at the grain joints of the metastable austenite. The zone between the curves $X_1$, $X_2$ is marked $\omega$. The pearlitization consists in passing the wire from the state represented by the point B, to the left of the zone $\omega$, to a state represented by the point C, to the right of the zone $\omega$. This transformation of the wire is, for example, diagrammatically indicated by the straight line segment BC which intersects the curve $X_1$ at $B_x$ and the curve $X_2$ at $C_x$, but the invention also applies to cases in which the variation in temperature of the wire between the points B and C is not linear.

The formation of the seeds continues in the part of the segment BC located to the left of the zone $\omega$, that is to say in the segment BBx. In the part of the segment BC passing through the zone $\omega$, that is the say in the segment $B_xC_x$, there is transformation of metastable austenite into pearlite, that is to say pearlitization. The pearlitization time may vary from one steel to another; thus the treatment represented by the segment $C_xC$ has the purpose of avoiding applying premature cooling to the wire in the event that the pearlitization has not terminated. In fact, residual metastable austenite which would undergo a rapid cooling would be transformed into bainite, which is not a structure favorable to wire drawability after heat treatment nor to the value in use and mechanical properties of the final product.

A rapid cooling between points A and B followed by substantially isothermal holding in the region of metastable austenite, that is to say between the points B and $B_x$, permits an increase in the number of seeds and a decrease in their size. These seeds are the starting points for the further transformation of the metastable austenite into pearlite, and it is well-known that the fineness of the pearlite and, therefore, the value in use of the wire will be greater, the more numerous and smaller these seeds.

After the pearlitization treatment, the wire is cooled, for instance to ambient temperature, this cooling, which is preferably rapid, being indicated diagrammatically, for instance, by the curved line segment CD, the temperature at D being marked $\theta_D$ in FIG. 1.

Figure 2:
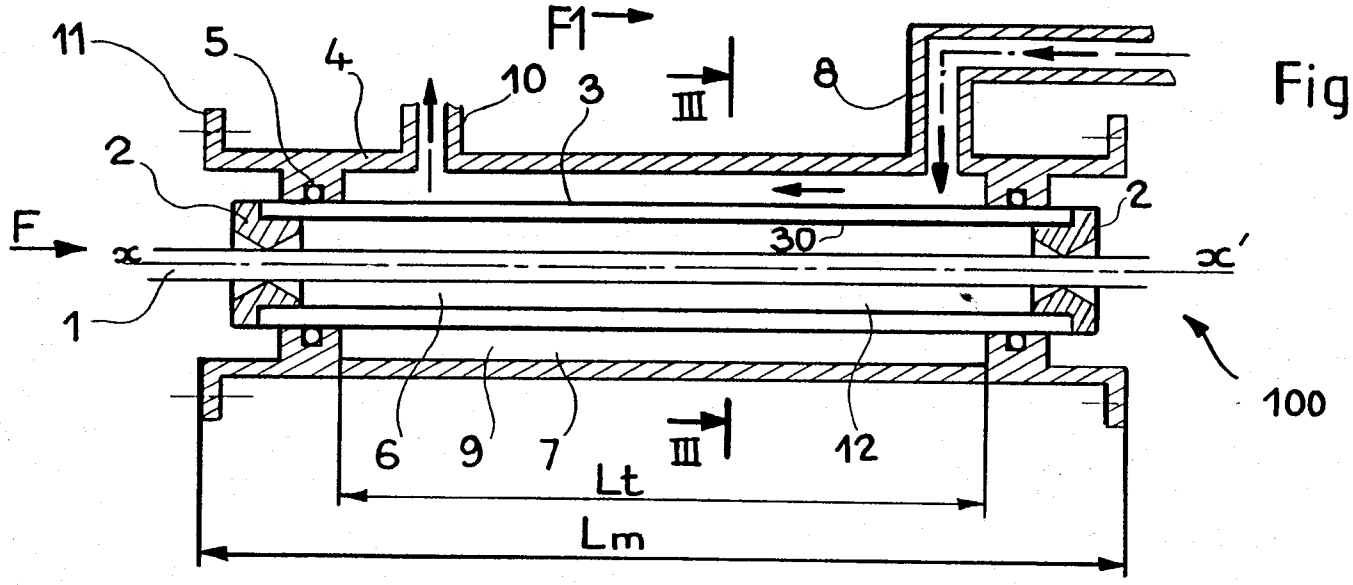
FIG. 2 shows a device according to the invention, said figure being a section taken along the axis of the device.
Figure 3:
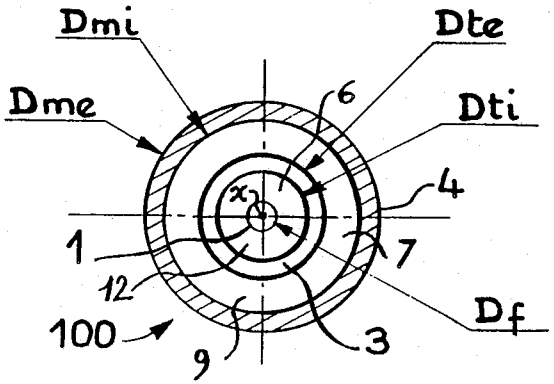
FIG. 3 shows the device of FIG. 2 along a section perpendicular to the axis of the device, said section being indicated diagrammatically by the lines III—III in FIG. 2.

FIGS. 2 and 3 show a device 100 in accordance with the invention. This device 100 is a heat exchanger having an enclosure 3 in the form of a tube of an inside diameter of $D_{ti}$ and an outside diameter of $D_{te}$ in which the wire 7 to be treated passes in the direction indicated by the arrow F. The diameter of the wire 1 is labeled $D_f$, this wire 1 being a carbon steel wire to be heat-treated in the device 100.

FIG. 2 is a section taken along the axis xx' of the wire 1 which is also the axis of the device 100, and FIG. 3 is a section taken perpendicular to this axis xx', the section of FIG. 3 being indicated diagrammatically by the lines III—III in FIG. 2 and the axis xx' being indicated diagrammatically by the letter "x" in FIG. 3. The drive means for the wire 1 are known means and are not shown in FIGS. 2 and 3 in order not to complicate the figures. The drive means comprises, for instance, a winder driven by a motor in order to wind the wire up after treatment. The space 6 between the wire 1 and the tube 3 is filled with a gas 12 which is directly in contact with the wire 1 and with the inner wall 30 of the tube 3. The gas 12 remains in the space 6 during the treatment of the wire 1, the device 100 being without means capable of providing forced ventilation of the gas 12; in other words the gas 12 is not subject to forced ventilation, although some movement of the gas within the space 6 may be induced by movement of the wire 1 in the direction of the arrow F. Upon the heat treatment of the wire 1, a transfer of heat takes place from the wire 1 to the gas 12. $\lambda$ is the conductivity of the gas 12 determined at 600° C. This conductivity is expressed in watts.$m^{-1}$.$^oK^{-1}$. The wire 1 is guided by two wire guides 2 consisting, for instance, of a ceramic or tungsten carbide, one of these guides 2 being located at the entrance and the other at the exit of the wire 1 in the tube 3. The tube 3 is cooled on the outside by a heat exchange fluid 9, for instance water, circulating in an annular sleeve 4 which surrounds the tube 3. This sleeve 4 has a length $L_m$, an inside diameter Dmi, and an outside diameter $D_{me}$. The sleeve 4 is supplied with water 9 through the connection 8 and the water 9 leaves the sleeve 4 through the connection 10, the flow of the water 9 along the tube 3 taking place thus in a direction opposite the direction F. The tightness between the zone 7 containing the water 9 (inside volume of the sleeve (4) and the space 6 containing the gas 12 is obtained by means of joints 5 made, for instance, of elastomers. The length of the tube 3 in contact with the fluid 9 is indicated as $L_t$ in FIG. 2.

The exchanger 100 may in itself constitute a device in accordance with the invention. Several exchangers 100 can also be fastened end to end together along the axis xx' by means of flanges 11 forming the ends of the sleeve 4, the wire 1 than passing through several exchangers 100 arranged in series along the axis xx'.

These devices permit the heat treatment of the wire 1 represented by the part of the curve $\phi$ located between the points A and C, that is to say a treatment comprising a cooling followed by a pearlitization. These devices may also serve for the cooling of the wire 1 after pearlitization if desired, this cooling corresponding to the part CD of the curve $\phi$.

The characteristics of the tube 3, of the wire 1 and of the gas 12 are so selected that the following relationships are satisfied, at least upon the cooling preceding the pearlitization and indicated diagrammatically by the part AB of the curve $\phi$:

$$1.05 \leqq R \leqq 15 \quad (1)$$

$$5 \leqq K \leqq 10 \quad (2)$$

in which $$R = D_{ti}/D_f$$

$$K = [\mathrm{Log}\,(D_{ti}/D_f)] \times D_f^2$$

$$R = D_{ti}/D_f/\lambda$$

$D_{ti}$ and $D_f$ being expressed in millimeters, $\lambda$ being the conductivity of the gas determined at 600° C. and expressed in watts.$m^{-1}$.$^oK^{-1}$, Log being the natural logarithm. $D_f$ is not greater than 6 mm.

The gas 12 is, for instance, hydrogen, nitrogen, or helium or one of the following mixtures: hydrogen and nitrogen; hydrogen and methane; nitrogen and methane; helium and methane; or hydrogen, nitrogen and methane.

For wires 1 of large diameter, the ratio R between the inside diameter $D_{ti}$ and the diameter $D_f$ of the wire is close to 1, and the use of a very conductive gas 12, for instance hydrogen, becomes necessary.

Figure 5:
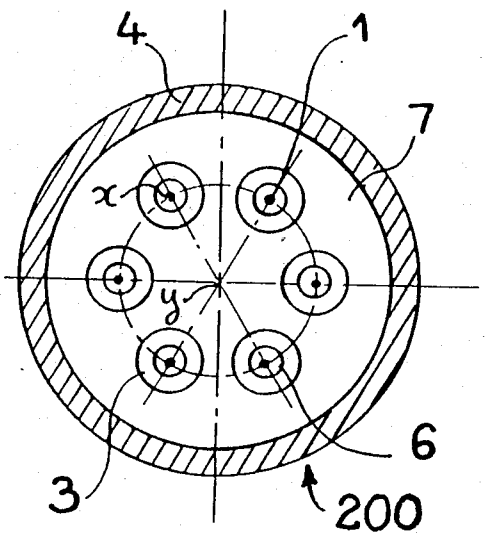
FIG. 5 shows the device of FIG. 4 in a section perpendicular to the axis of the device, said section being indicated diagrammatically by the lines V—V in FIG. 4.
Figure 4:
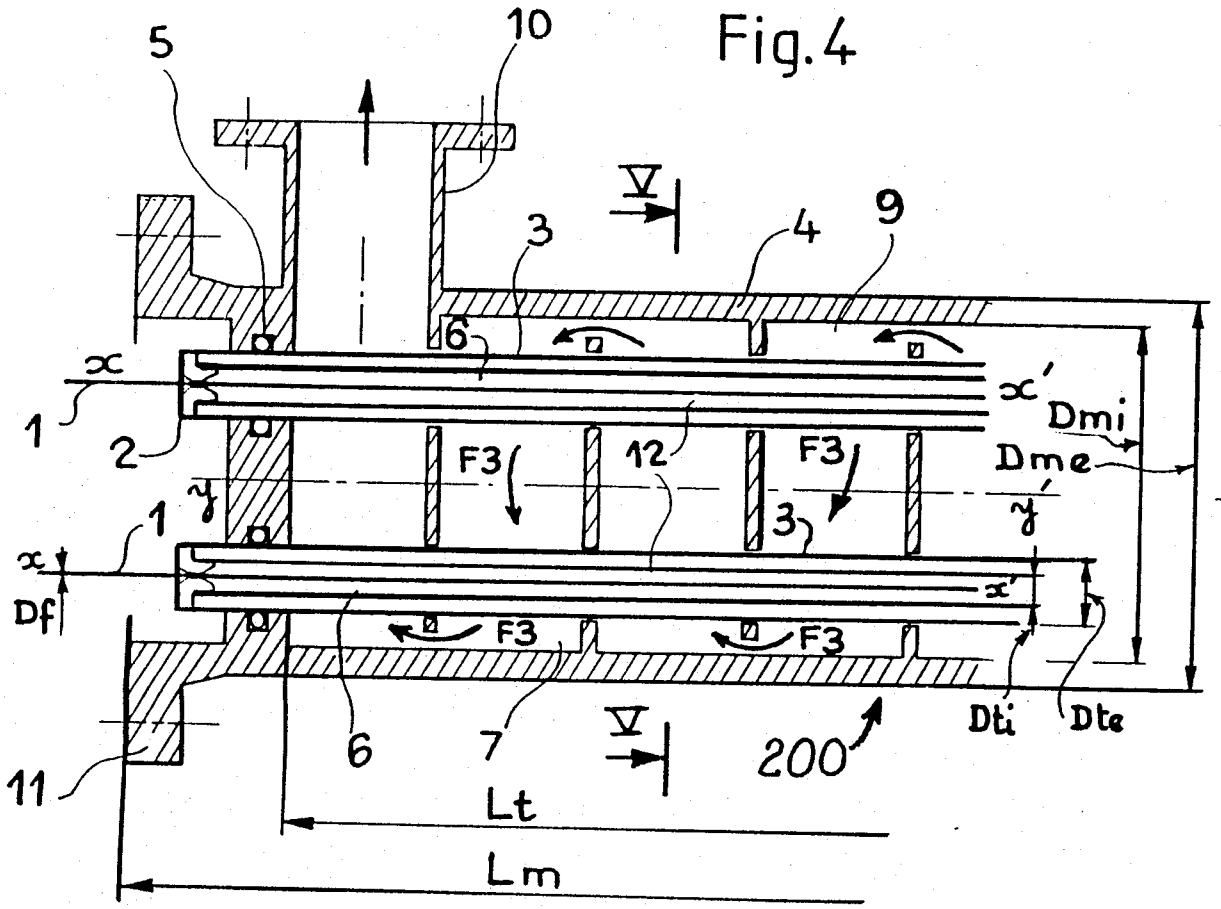
FIG. 4 shows another device according to the invention, this figure being a section taken along the axis of the device.

FIGS. 4 and 5 show another device 200 in accordance with the invention having an axis yy', FIG. 4 being a section along this axis and FIG. 5 being a section perpendicular to this axis, the section of FIG. 5 being indicated diagrammatically by the straight-line segments V—V of FIG. 4, the axis xx' being indicated diagrammatically by the letter "x", and the axis yy' being indicated diagrammatically by the letter "y" in FIG. 5.

This exchanger 200 is similar to the exchanger 100 previously described, with the difference that it has six tubes 3 surrounded by the cylindrical sleeve 4, a wire 1 being arranged along the axis xx' of each of these tubes, this axis xx' being therefore also the axis of the wire 1 disposed in this tube 3. Each of these tubes 3 is filled by the gas 12, as in the case of the exchanger 100, and the inner volume 7 of the sleeve 4, on the outside of the tubes 3, is the site of a circulation of heat-exchange fluid, for instance water.

Like the exchanger 100, the exchanger 200 may by itself alone constitute a device according to the invention or it may be assembled coaxially with other exchangers 200 by means of flanges 11 forming ends of the sleeves 4, the wires 1 thus passing through several exchangers 200 arranged in series.

In order to obtain a transformation of austenite into pearlite under the best conditions, it is preferable that the transformation steps of the wire indicated diagrammatically by the line BC in FIG. 1 take place at a temperature which varies as little as possible, the temperature of the wire 1, for instance, not differing by more than 10° C. plus or minus from the temperature $\theta_B$ obtained after the cooling indicated diagrammatically by the line AB. This limitation of the variation of the temperature is applicable for a time greater than the pearlitization time, the pearlitization time corresponding to the segment BxCx. The temperature of the wire 1 preferably does not differ by more than 5° C. plus or minus from the temperature $\theta_B$ this line BC. FIG. 1 shows, for instance, the ideal case in which the temperature is constant and equal to $\theta_B$ during the steps indicated diagrammatically by the line BC, which is therefore a straight line segment parallel to the abscissa axis.

The transformation of austenite into pearlite which takes place in the region $\omega$ gives off an amount of heat of about 100,000 $J.Kg^{-1}$, with a rate of transformation which varies in this region as a function of the time, this rate being low in the vicinity of the points $B_x$ and $C_x$ and maximum towards the middle of the segment $B_xC_x$. Under these conditions, if a practically constant temperature is desired upon this transformation, it is necessary to effect modulated heat exchanges, that is to say heat exchanges, the power of which per unit of length of the wire 1 varies along the device where this transformation takes place, the cooling due to the gas 12 being maximum when the rate of pearlitization is maximum, this in order to avoid the phenomenon of recalescence due to an excessive increase in temperature of the wire 1 upon the pearlitization.

The modulation of the heat exchanges can be effected preferably by varying either the inside diameter of the tubes 3 through which the wire passes or the length of the different tubes 3 through which the wire passes.

Figure 6:
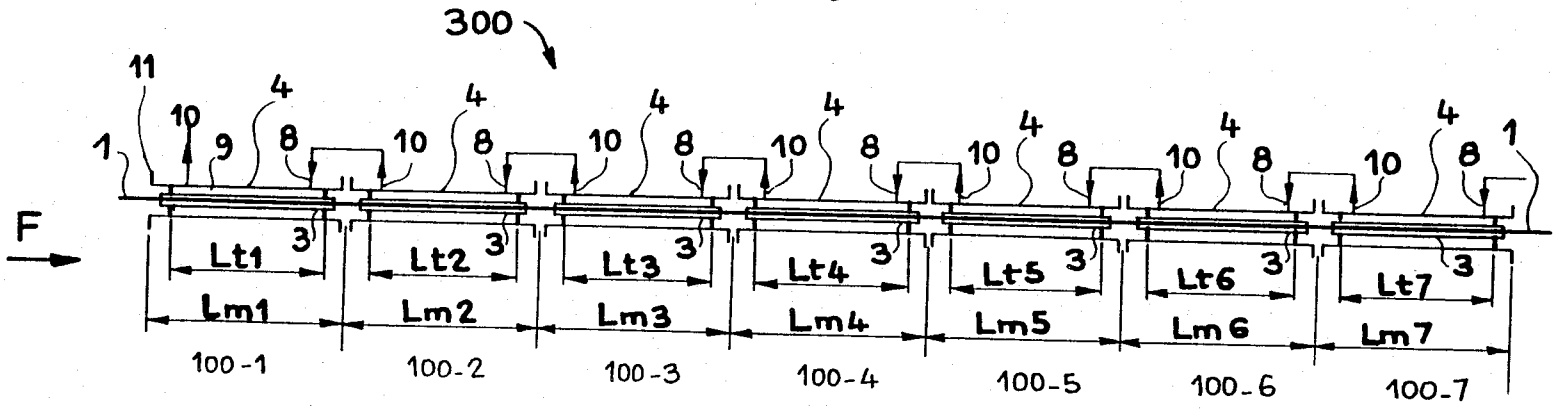
FIGS. 6 and 7 each show another device according to the invention.

FIG. 6 shows an exemplary device in which the modulation of the heat exchanges is effected by varying the inside diameter of the tubes. The device 300 according to the invention of FIG. 6 comprises seven heat exchangers similar to the exchanger 100 previously described and shown in FIGS. 2 and 3. These exchangers 100-1 to 100-7 are connected in series by their flanges 11. The wire 1 passes from the exchanger 100-1 to the exchanger 100-7 in the direction indicated by the arrow F. The outlet connection 10 for the outflow of the water from each exchanger is connected to the inlet connection 8 of the previous exchanger. The water 9 therefore flows in series through these exchangers 100 in the direction opposite that of the arrow F. For each of the exchangers 100, the inside diameter $D_{ti}$ of the tube 3 is constant, but the diameter $D_{ti}$ varies from the exchanger 100-1 to the exchanger 100-7 in the following manner:

- the diameter $D_{ti}$ decreases from the exchanger 100-2 to the exchanger 100-4 so that the cooling power per unit of length increases from the exchanger 100-2 to the exchanger 100-4;
- the diameter $D_{ti}$ increases from the exchanger 100-4 to the exchanger 100-6, which makes it possible to obtain decreasing cooling powers per unit of length.

The element lengths, marked $L_{m1}$ to $L_{m7}$, are constant in the case of the elements 100-1 to 100-7 as are the tube 3 lengths in contact with the water, marked $L_{t1}$ to $L_{t7}$.

The exchanger 100-4, the cooling power of which is the highest, corresponds therefore to the zone where the rate of pearlitization is the greatest.

In this zone there are the following relationships:

$$1.05 \leqq R \leqq 8 \quad (3)$$

$$3 \leqq K \leqq 8 \quad (4)$$

R and K having the same meanings as indicated above.

Figure 7:
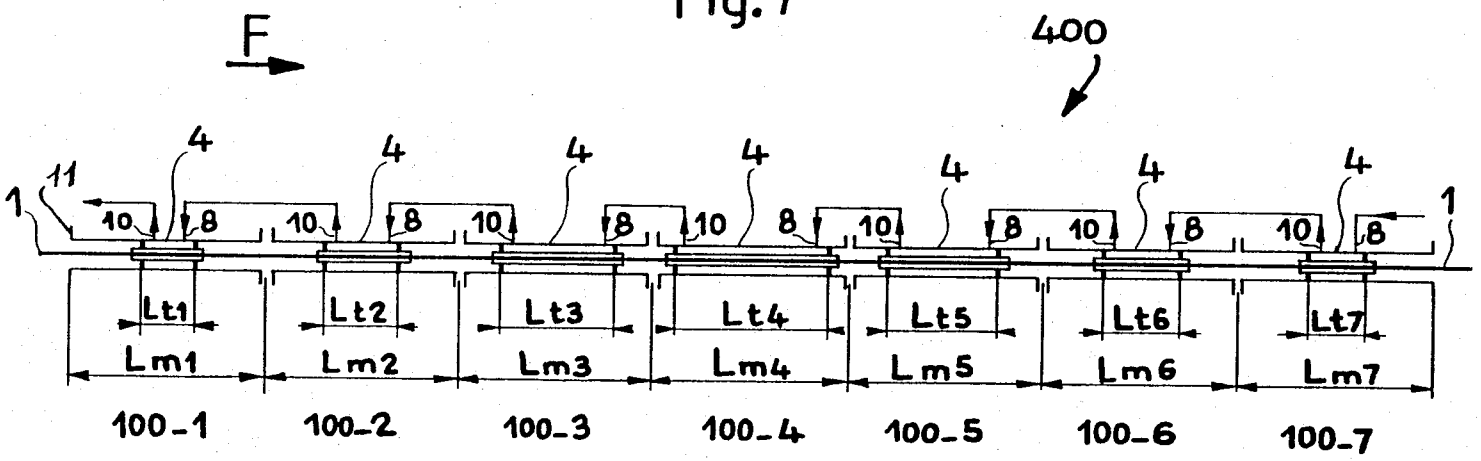

The device 400 shown in FIG. 7 has the same general structure as the device 300 of FIG. 6, with seven exchangers marked 100-1 to 100-7 connected in series by their flanges 11. The device 400 differs from the device 300 in that the exchangers 100 of the device 400 all have the same inside diameter $D_{ti}$ for the tubes 3 and in that the lengths $L_t$ measured parallel to the wire 1 of the tubes 3 in contact with the fluid 9 are varied. The lengths of all of the elements $L_{m1}$ to $L_{m7}$ in FIG. 7 may for instance be equal.

In FIG. 7 the lengths of tubes 3 are marked $L_{t1}$ to $L_{t7}$ for the exchangers 100-1 to 100-7 of the device 400. The exchangers 100-2 to 100-4 have lengths of tubes $L_{t2}$ to $L_{t4}$ increasing in the direction of the arrow F, so that there is an increase in the average cooling power with respect to a given length of wire from the exchanger 100-2 up to the exchanger 100-4. On the other hand, the lengths $L_{t4}$ to $L_{t6}$ decrease in the direction of the arrow F so that there is a decrease in the average cooling power referred to unit length of wire from the exchanger 100-4 to the exchanger 100-6. The exchanger 100-4, the cooling power of which is the highest, corresponds here again to the zone where the rate of pearlitization is the greatest and the relations (3) and (4) previously indicated for the device 300 are again satisfied here.

In the modulation devices 300 and 400 the relations (3) and (4) stated above need be followed only for the exchangers 100-4 where the rate of pearlitization is the fastest.

In the devices 300 and 400, the exchangers 100-1 and 100-7 produce relatively small heat exchanges per unit of length, either because the corresponding diameter $D_{ti}$ is high in the case of the device 300 or because the corresponding length $L_{ti}$ is small in the case of the device 400, and it is not essential that these exchangers 100-1 and 100-7 satisfy any of the relations (1) to (4) stated above. The exchangers 100-1 and 100-7 maintain the wire 1 at the substantially constant temperatures desired in the stages before and after pearlitization, that is to say for the parts $BB_x$ and $C_xC$ of the segment BC which are located to the outside of the zone $\omega$ (FIG. (1), the wire temperature being, therefore, practically constant over the segment BC. The segment $C_xC$ represents a practically isothermal state maintained after pearlitization in order to avoid applying premature cooling to the wire 1 in the event that the pearlitization should not be complete, since the pearlitization time is capable of varying from one steel to another, as previously stated.

In order to obtain a constant temperature of the wire in the exchangers 100-1 and 100-7 it may be advantageous to pass an electric current through the wire 1 when it passes through these exchangers; for this purpose, one could also replace these exchangers 100-1 and 100-7 by muffle furnaces held at the temperature $\theta_B$. The devices for passing the electric current or the muffle furnaces are not shown in FIGS. 6 and 7 for the sake of simplification. The invention also includes devices in which both the diameter $D_{ti}$ and the length $L_t$ are varied in the same device. Furthermore, in the devices 300 and 400 one could use exchangers 200 (FIGS. 4 and 5) connected in series so as simultaneously to treat several wires.

Furthermore, instead of using several tubes 3 of different diameter, one can use a single tube, the diameter of which varies along its axis in order to effect the modulation of the heat exchanges which was previously described while respecting the relationships (3) and (4) in the zone where the rate of pearlitization is maximum.

Figure 8:
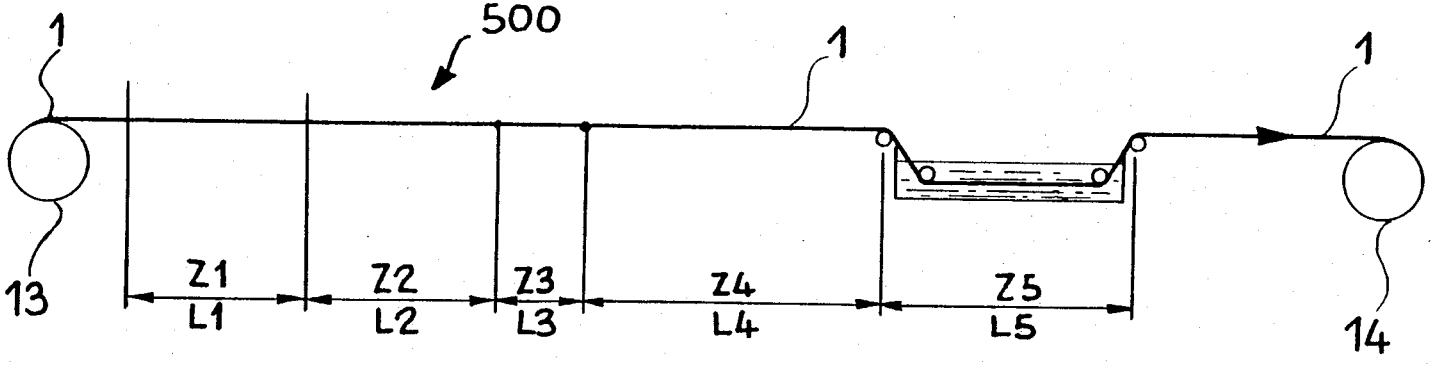
FIG. 8 shows a complete installation for the heat treatment of a steel wire, this installation employing at least one device in accordance with the invention.

FIG. 8 shows diagrammatically a complete installation for treating a wire 1, this installation in accordance with the invention using at least one of the devices previously described.

This installation 500 has five zones marked $Z_1$ to $Z_5$ The wire 1 coming from the spool 13 is heated in the zone $Z_1$ in known manner, for instance by means of a gas or muffle furnace, up to a temperature of 900° to 1000° C. in order to obtain a homogeneous austenite corresponding to point A of FIG. 1, this temperature being greater than the Ac3 transformation temperature.

The wire 1 is then cooled in the zone $Z_2$ to a temperature of 500° to 600° C. so as to obtain a metastable austenite corresponding to point B of FIG. 1.

The wire 1 then passes into the zone $Z_3$ where it undergoes the treatments corresponding to the segment BC of FIG. 1. The wire then passes into the zone $Z_4$ where it is to a temperature, for instance, of about 300° C. The then moves into the zone $Z_5$ where it is brought to a temperature close to ambient temperature, for instance 20° to 50° C, by immersion in water. The cooling effected in the zones $Z_4$ and $Z_5$ corresponds to the segment CD of FIG. 1.

The wire 1 emerging from the zone $Z_5$ is then wound on the spool 14.

The zones $Z_2$ to $Z_4$ can, for instance, use exchangers of the same type as the exchangers 100, 200 previously described with a modulation device 300 or 400 possibly for the zone $Z_3$.

The invention has the following advantages:

simplicity and low investment and operating costs, since:

one avoids the use of molten metals or salts; and one dispenses with the use of compressors or turbines which would be necessary with a forced circulation of gas;

one can obtain a precise rate of cooling and avoid the phenomenon of recalescense;

it is possible to accomplish with the same installation a pearlitization treatment on wires of diameters $D_f$ which vary within wide limits, $D_f$ being, however, not greater than 6 mm and preferably not less than 0.4 mm;

one avoids any problems of expensive environmental protections and cleaning of the wire is not necessary because molten metals or salts are not used.

These advantages are obtained only when relations (1) and (2) are satisfied upon the cooling indicated diagrammatically by the portion AB of the curve $\phi$ (FIG. (1). When tubes containing a gas without forced ventilation are used, the tube being surrounded by a heat exchange fluid, but the relations (1) and (2) are not satisfied upon the cooling preceding pearlitization and corresponding to the portion AB of the curve $\phi$, it is not possible to effect a correct pearlitization.

The invention is illustrated by the nine examples which follow, all of which are in accord with the invention.

The wires treated in these examples are made of steel, the compositions of the steels and their Ac1 and Ac3 transformation temperatures being given in the Table 1, corresponding with the Examples.

TABLE 1

| Examples | T° Ac1 (in °C.) | T° Ac3 (in °C.) | C | Mn | Si | S |
|---|---|---|---|---|---|---|
| 1, 2, 3, 7, 8, 9 | 730 | 780 | 0.85 | 0.70 | 0.20 | 0.027 |
| 4, 5, 6 | 730 | 730 | 0.70 | 0.60 | 0.22 | 0.029 |

TABLE 1-continued

| Examples | P | Al | Ca | Cr | Ni |
|---|---|---|---|---|---|
| 1, 2, 3, 7, 8, 9 | 0.019 | 0.082 | 0.045 | 0.060 | 0.015 |
| 4, 5, 6 | 0.018 | 0.084 | 0.049 | 0.062 | 0.014 |

All the examples are carried out with an installation in accordance with the invention which has the five zones $Z_1$ to $Z_5$ previously described. This installation makes use of heat exchangers 100 or 200 for zones $Z_2$ and $Z_4$ and of devices 300 or 400 for zone $Z_3$ in the case of Examples 1 to 8, which are carried out with avoidance of the phenomenon of recalescence, that is to say with a practically constant temperature in zone $Z_3$. Example 9, on the other hand, is carried out without taking measures to prevent recalescense, the temperature varying in zone $Z_3$. The conditions of Example 9 will be described below. For Examples 1 to 8 the conditions are as follows:

(a) the speed of the wire is 1 meter per second.

(b) the lengths of the different zones $Z_1$ to $Z_5$, measured along the wire, are as follows: for zone $Z_1$, 3 m; for zone $Z_2$, 2.6 m; for zone $Z_3$, 3 m; for zone $Z_4$, 3 m; for zone $Z_5$, 1 m; these lengths bear the reference numbers $L_1$ to $L_5$ in FIG. 8

(c) the temperatures of the wires are as follows:

at the outlet from zone $Z_1$: 975° C.

at the outlet from zone $Z_2$ and throughout zone $Z_3$: 550° C.

at the outlet from zone $Z_4$: 300° C.

For all Examples 1 to 9 the duration of the cooling time in zone $Z_2$ is less than 5 seconds, this cooling corresponding to the portion AB of the Curve $\phi$ (FIG. 1).

The Examples are carried out in the following manner:

EXAMPLE 1

Diameter of the wire 1 treated: 1.3 mm

Heat-conductive gas 12: cracked $NH_3$, (percentage by volume: $H_2$=75%, $N_2$=25%).

Flow of water 9 at 20° C: 8 liters per minute, all sleeves 4 being in series.

The characteristics of the exchanger 100 of zone $Z_2$, are as follows:

Tube 3 made of pyrex glass, the diameters being as follows: $D_{ti}$=5 mm, $D_{te}$=10 mm.

Diameters of the sleeve 4: $D_{mi}$=35.2 mm; $D_{me}$=42.4 mm.

For a temperature of the wire of 975° C, the temperatures of the tube 3 are as follows: inner face 190° C., outer face 65° C.

The characteristics of zone $Z_3$ are as follows: use of device 300, with modulation by variation of $D_{ti}$, the values of $D_{ti}$ and $D_{te}$ being the following for the exchangers 100-1 to 100-7:

For exchangers 100-1 and 100-7: $D_{ti}$=0.25 mm; $D_{te}$=35 mm,

For exchangers 100-2 and 100-6: $D_{ti}$=5 mm, $D_{te}$10 mm

For exchangers 100-3 and 100-5: $D_{ti}$=4 mm, $D_{te}$=8 mm,

For exchanger 100-4: $D_{ti}$=3 mm, $D_{te}$=8 mm.

The exchanger 100-4 is the one in which the rate of pearlitization is maximum.

The diameters of the sleeves 4 have in all cases the following values: $D_{mi}$=35.2 mm, $D_{me}$=42.4 mm.

The different lengths Lm of the sleeves 4 are as follows: For the exchangers 100-1 and 100-7, $L_m=0.75$ m.

For the exchangers 100-2 to 100-6, $L_m=0.30$ m, which corresponds therefore to a total length of 3 m.

The characteristics of the exchanger 100 forming the zone $Z_4$ are as follows:

Tube 3 of pyrex glass with $D_{ti}=5$ mm, $D_{te}=10$ mm. The diameters of the sleeve 4 are as follows: $D_{mi}=35.2$ mm, $D_{me}=42.4$ mm.

The value of λ at 600° C. is equal to 0.28 watt.m$^{-1}$.°K$^{-1}$. Table 2 below gives the values of R and K for the zones $Z_2$ to $Z_4$ with indication of the relations (1) to (4) that are satisfied.

TABLE 2

| Zone | R | K | Relations (1) to (4) Satisfied |
|---|---|---|---|
| $Z_2$ | 3.85 | 8.13 | (1), (2), (3) |
| $Z_3$ | | | |
| Exchangers 100-1 and 100-7 | 19.23 | 17.84 | no relations satisfied |
| Exchangers 100-2 and 100-6 | 3.85 | 8.13 | (1), (2), (3) |
| Exchangers 100-3 and 100-5 | 3.08 | 6.78 | (1) to (4) |
| Exchanger 100-4 | 2.31 | 5.05 | (1) to (4) |
| $Z_4$ | 3.85 | 8.13 | (1), (2), (3) |

After treatment in the installation 500, the wire 1 has a tensile strength of 1350 MPa (megapascals). This wire is then brass-coated and then drawn in known manner to obtain a final diameter of 0.20 mm. The tensile strength for this drawn wire is 3500 MPa. The ratio of the cross sections corresponds by definition to the ratio of the cross section of the wire before drawing to the cross section of the wire after drawing.

For example 1, the ratio of the cross sections is equal to 42.25.

EXAMPLE 2

This example is carried out under the same conditions as Example 1, furthermore varying the diameter $D_f$ of the wire and the composition of the hydrogen/nitrogen mixture. In all the cases, the exchangers of zones $Z_2$ and $Z_4$ satisfy the relations (1) and (2) and the exchanger 100-4 in which the rate of pearlitization is maximum in the device 300 of the zone $Z_3$, satisfies the relations (3) and (4). Table 3 gives the values of $D_f$, R and K for the exchangers of zones $Z_2$, $Z_4$ and for the exchanger 100-4 of device 300, the volumetric percentage of hydrogen in the gaseous mixtures as well as the values of λ at 600° C. The values of R and K for the zones $Z_2$ and $Z_4$ are marked $R_M$, $K_M$ respectively and the values of R and K for the exchanger 100-4 are marked $R_m$ and $K_m$ respectively.

Table 3 furthermore gives the following values:

the tensile strength of the wire after heat treatment, expressed in MPa;

the diameter of the wire after drawing, expressed in mm;

the ratio of the cross sections due to the drawing;

the tensile strength of the wire after drawing expressed in MPa.

TABLE 3

| $D_f$ | $R_M$ | $R_m$ | % $H_2$ | λ | $K_M$ | $K_m$ |
|---|---|---|---|---|---|---|
| 1.55 | 3.23 | 1.94 | 100 | 0.42 | 6.7 | 3.78 |
| 1.30 | 3.85 | 2.31 | 75 | 0.28 | 8.1 | 5.05 |
| 0.94 | 5.32 | 3.19 | 50 | 0.18 | 8.2 | 5.70 |
| 0.82 | 6.10 | 3.66 | 40 | 0.15 | 8.1 | 5.81 |
| 0.53 | 9.43 | 5.66 | 12 | 0.076 | 8.3 | 6.41 |
| 0.40 | 12.50 | 7.50 | 0 | 0.050 | 8.1 | 6.45 |

TABLE 3-continued

| Tensile Strength After Heat Treatment (MPa) | Drawn Diameter (mm) | Ratio of the Cross Sections | Tensile Strength in the Final Diameter (MPa) |
|---|---|---|---|
| 1340 | 0.23 | 45.41 | 3450 |
| 1350 | 0.20 | 42.25 | 3500 |
| 1352 | 0.145 | 42.02 | 3510 |
| 1355 | 0.125 | 43.03 | 3490 |
| 1350 | 0.08 | 43.89 | 3500 |
| 1355 | 0.06 | 44.44 | 3520 |

EXAMPLE 3

This example is carried out under the same conditions as Example 1 except in the case of the zone $Z_3$ which is carried out with the device 400. The characteristics of the exchangers 100 of this device 400 are as follows:

All the tubes 3 are of alumina, the diameters $D_{ti}$ and $D_{te}$, which are identical for the seven exchangers 100, having the following values: $D_{ti}=3$ mm, $D_{te}=8$ mm. The lengths $L_t$ of the tube vary in the following manner: for exchangers 100-1 and 100-7, $L_t=0.15$ m; for exchangers 100-2 and 100-6, $L_t=0.20$ mm; for exchangers 100-3 and 100-5, $L_t=0.25$ m; for exchanger 100-4, $L_t=0.28$ m.

All the exchangers 100-1 to 100-7 satisfy relations (1) to (4), with λ=0.28; R=2.31; K=5.05. After treatment in the installation 500, the wire 1 has a tensile strength of 1340 MPa. The wire 1 thus obtained and then brass coated and drawn in known manner to a diameter of 0.2 mm has a tensile strength equal to 3480 MPa, the ratio of the cross sections being equal to 42.25.

EXAMPLE 4

A wire of a diameter $D_f=2$ mm is used. The cooling gas 12 is pure hydrogen. The rate of flow of water at 20° C. is 19 liters per minute. The characteristics of the example are as follows:

Zone $Z_2$: Use of three exchangers 100 in series each having the following characteristics: tube 3 of steel enamelled on the inside. $D_{ti}=4.5$ mm; $D_{te}=10$ mm. Diameters of the sleeve 4: $D_{mi}=35.2$ mm; $D_{me}=42.4$ mm.

Zone $Z_3$ Use of a device 300 with tubes 3 of steel enamelled on the inside, the diameters of these tubes 3 being as follows:

for exchangers 100-1 and 100-7: $D_{ti}=25$ mm, $D_{te}=35$ mm for exchangers 100-2 and 100-6: $D_{ti}=3.5$ mm, $D_{te}=10$ mm for exchangers 100-3 and 100-5: $D_{ti}=3$ mm, $D_{te}=10$ mm.

for exchanger 100-4 $D_{ti}=2.8$ mm, $D_{te}=10$ mm.

Diameters of the sleeves 4: $D_{mi}=35.2$ mm, $D_{me}=42.4$ mm.

Zone $Z_4$: Use of three exchangers 100 in series, each having the following characteristics:

Tubes 3 of steel enamelled on the inside. $D_{ti}=4.5$ mm; $D_{te}=10$ mm. λ=0.42 watt.m$^{-1}$.°K$^{-1}$.

The exchangers of zones $Z_2$ and $Z_4$ satisfy the relations (1) and (2). Table 4 below giving the values of R and K for the exchangers 100-1 to 100-7 of device 300 as well as the relations (1) to (4) which are satisfied, when applicable.

TABLE 4

| No. of Exchangers | R | K | Relations (1) to (4) Satisfied |
|---|---|---|---|
| 100-1 and 100-7 | 12.5 | 24.05 | (1) |
| 100-2 and 100-6 | 1.75 | 5.33 | (1) to (4) |
| 100-3 and 100-5 | 1.50 | 3.86 | (1), (3), (4) |
| 100-4 | 1.40 | 3.20 | (1), (3), (4). |

After heat treatment, the wire 1 has a tensile strength equal to 1340 MPa. After brass coating and drawing are effected in known manner in order to obtain a diameter of 0.3 mm, the tensile strength is 3450 MPa, and the ratio of the cross sections is being 44.44.

EXAMPLE 5

This example is carried out with an installation using the exchangers 200 for the zones $Z_2$, $Z_3$, $Z_4$ so as to treat six wires 1 simultaneously.

The rate of flow of water at 20° C. is 110 liters per minute, and the diameters of the sleeves 4 are as follows:

$D_{mi}$=82.5 mm, $D_{me}$=88.9 mm

The other conditions of the example are the same as for Example 4.

After heat treatment, the wire 1 has a tensile strength of 1350 MPa. After brass coating and drawing in known manner in order to obtain a diameter of 0.3 mm, the tensile strength is 3500 MPa, and the ratio of the cross sections is 44.44.

EXAMPLE 6

The conditions are identical to those of Example 4, the diameter $D_f$ of the wires as well as the composition of the gas (mixture of hydrogen and nitrogen) being varied.

In all cases the exchangers of zones $Z_2$ and $Z_4$ satisfy the relations (1) and (2) and the exchanger 100-4 where the rate of pearlitization is maximum in the device 300 of zone $Z_3$ satisfies the relations (3) and (4).

Table 5 below gives the values of $D_f$R and K for the exchangers of zones $Z_2$ and $Z_4$ and for the exchanger 100-4 of device 300, the volumetric percentage of hydrogen in the gaseous mixtures as well as the values of λ at 600° C.

The values R and K for the zones $Z_2$ and $Z_4$ are marked $R_M$, $K_M$ respectively and the values of R and K for the exchanger 100-4 are marked $R_m$ and $K_m$ respectively.

Table 5 furthermore gives the following values:

the tensile strength of the wire after heat treatment, expressed in MPa;

the drawn diameter of the wire expressed in mm, that is to say the diameter of the wire after drawing;

the ratio of the cross sections due to the drawing;

the tensile strength of the wire in final diameter, that is to say after drawing, expressed in MPa.

TABLE 5

| $D_f$ | $R_M$ | $R_m$ | % $H_2$ | λ | $K_M$ | $K_m$ |
|---|---|---|---|---|---|---|
| 2.00 | 2.25 | 1.40 | 100 | 0.42 | 7.72 | 3.20 |
| 1.75 | 2.57 | 1.60 | 90 | 0.36 | 8.03 | 4.00 |
| 1.55 | 2.90 | 1.81 | 80 | 0.31 | 8.26 | 4.58 |
| 1.30 | 3.46 | 2.15 | 70 | 0.26 | 8.07 | 4.99 |
| 0.94 | 4.79 | 2.98 | 45 | 0.17 | 8.14 | 5.67 |
| 0.82 | 5.49 | 3.41 | 35 | 0.14 | 8.18 | 5.90 |
| 0.53 | 8.49 | 5.28 | 10 | 0.072 | 8.34 | 6.49 |
| 0.45 | 10.00 | 6.22 | 0 | 0.050 | 9.33 | 7.40 |

TABLE 5-continued

| Tensile Strength After Heat Treatment (MPa) | Drawn Diameter (mm) | Ratio of the Cross Sections | Tensile Strength in Final Diameter (MPa) |
|---|---|---|---|
| 1340 | 0.30 | 44.44 | 3450 |
| 1350 | 0.26 | 45.30 | 3500 |
| 1360 | 0.23 | 45.41 | 3520 |
| 1350 | 0.20 | 42.25 | 3500 |
| 1350 | 0.14 | 45.08 | 3510 |
| 1380 | 0.12 | 46.69 | 3480 |
| 1385 | 0.08 | 43.89 | 3500 |
| 1390 | 0.065 | 47.93 | 3510 |

EXAMPLE 7

This example is carried out under the same conditions as Example 1 but cracked ammonia, which is a decarburizing gas, has been replaced by a gas which maintains the thermodynamic equilibrium with respect to the carbon of the steel at 800° C. The volumetric composition of this gas is $H_2$=74%, $N_2$=24%, $CH_4$=2%. The values of R and K as well as the relations which are followed are identical to those in Table 2. The figures concerning the drawing and the strength of the wire are identical within 2% to those obtained for Example 1.

EXAMPLE 8

This example is carried out under the same conditions as Example 1 but the cracked ammonia has been replaced by a carburizing gas which makes it possible to correct a decarburization produced in the treatments prior to the heat treatment according to the invention. Volumetric composition of the gas: $H_2$=63.75%, $N_2$=21.25%, $CH_4$=15%. No deposit of graphite is observed on the surface of the wire; the recarburization thickness is on the order of 3 μm.

The values of R, K as well as the relations satisfied are identical to those entered in Table 2. After heat treatment the wire has a tensile strength of 1320 MPa. After brass coating and drawing, effected in known manner in order to obtain a diameter of 0.2 mm, the ratio of the cross sections is 42.25, and the tensile strength is 3450 MPa.

EXAMPLE 9

This example is carried out without taking steps to avoid recalescence. Diameter $D_f$ of the wire 1=5.5 mm; rate of passage of the wire 1=1.5 m/sec.

Zones $Z_2$, $Z_3$, $Z_4$ each use an exchanger 100, these exchangers being all identical, with tubes 3 of steel enamelled on the inside with $D_{ti}$=6 mm, $D_{te}$=12 mm. Flow of water at 20° C. =120 liters per minute; cooling gas: pure hydrogen. Total time of heat treatment=9.9 seconds. Length of the heat treatment installation (zones $Z_2$ to $Z_4$)=14.8 m.

The temperatures of the wire are as follows:

at the outlet of zone $Z_1$: 975° C., at the start of the transformation from metastable austenite into pearlite (point B, in FIG. (1): 550° C., at the outlet from zone $Z_4$: 350° C.

The difference between the minimum temperature and the maximum temperature during the transformation of the austenite into pearlite (recalescence) is 60° C.

λ=0.42R=1.091; K=6.27.

After heat treatment the wire has a tensile strength of 1310 MPa. After brass coating and drawing effected in known manner in order to obtain a diameter of 0.84 mm, the ratio of the cross sections being 42.87, the wire has a tensile strength of 3350 MPa.

The wire 1 treated in accordance with the invention has the same structure as that obtained by the known process of lead patenting, that is to say a fine pearlitic structure.

Figure 9:
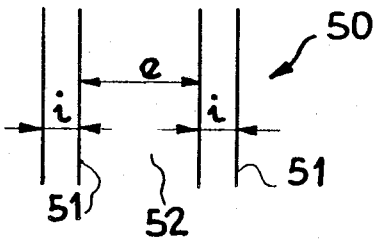
FIG. 9 shows diagrammatically in section a portion of the fine pearlitic structure of a wire treated in accordance with the invention.

This structure has cementite lamellae separated by ferrite lamellae. By way of example, FIG. 9 shows in cross section a portion 50 of such a fine pearlitic structure. This portion 50 has two lamellae of cementite 51 which are practically parallel and separated by a lamella of ferrite 52. The thickness of the cementite lamellae 51 is represented by "i" and the thickness of the ferrite lamellae 52 is represented by "e." The pearlitic structure is fine, that is to say the average value i+e is at most equal to 1000 Å, with a standard deviation of 250 Å.

All the Examples 1 to 9 previously described make it possible to obtain a structure corresponding to that previously described for the portion 50, but the structure obtained is finest when recalescence is avoided during pearlitization.

The invention preferably makes it possible to obtain at least one of the following results:

After heat treatment and before drawing the wire has a tensile strength of not less than to 1300 MPa;

the wire can be drawn in such a manner as to have a ratio of the cross sections of not less than 40;

the wire, after drawing, has a tensile strength of not less than 3000 MPa.

By way of comparison, the two Examples 10 and 11 which follow are not in accord with the invention. These two comparative examples were carried out with an installation similar to the installation 500 previously described which has the zones $Z_1$ to $Z_5$. Each of the zones $Z_2$, $Z_3$, $Z_4$ uses an exchanger 100, these exchangers being all identical with tubes 3 of pyrex glass, with $D_{ti}=0.25$ mm and $D_{te}=35$ mm.

The diameters of the sleeves have the following values in all cases: $D_{mi}=50$ mm, $D_{me}=60$ mm. The installation length is 18 m (zones $Z_2$ to $Z_4$)

In the two comparative examples, the heat conductive gas 12 is cracked ammonia containing 75% hydrogen and 25% nitrogen (% by volume). The conductivity λ at 600° C. is equal to 0.28 watt.m$^{-1}$.°K$^{-1}$. The steel contains 0.7% carbon; it is identical to the one used for the preceding Examples 4, 5, 6 (Table 1).

The conditions specific to comparative Examples 10 and 11 are as follows:

EXAMPLE 10

Diameter of the wire treated: 1.3 mm; speed of advance of the wire: 1 meter per second. In this example R=19.23 and K=17.8, and thus none of the relationships (1) to (4) are followed. The temperature of the wire at the outlet from zone $Z_1$ is 975° C. The cooling time in zone $Z_2$ is 6.7 seconds, the wire having a temperature of about 600° C. upon emergence from this zone $Z_2$.

The time of passage in zone $Z_3$ is 4.6 seconds, the pearlitization being terminated at the exit from zone $Z_3$.

The recalescence is extensive; the difference in temperature between the minimum temperature and the maximum temperature of the wire during the transformation from austenite into pearlite (zone $Z_3$) being 80° C.

After the heat treatment described, the wire has a tensile strength of 1100 MPa. The wire is then brass coated and then drawn in known manner to a diameter of 0.23 mm and it then has a tensile strength equal to 2765 MPa for a ratio of the cross sections of 31.95. This example, which is not in accord with the invention, therefore results in excessive recalescence and low tensile strength values before and after drawing. Also, the structure of the wire, after the heat treatment described in this example, follows the relationship $i+e=1350$Å (mean value), the standard deviation being 255 Å, this structure therefore not being in accord with the structure previously described.

EXAMPLE 11

Diameter of the treated wire: 2.8 mm; speed of advance of the wire: 0.5 m/sec.

R=8.93 and K=61.3. Relationship (1) is therefore the only one of relations (1) to (4) which is followed.

The temperature of the wire upon emergence from zone $Z_1$ is 975° C. as in the preceding example.

The time of passage through the zone $Z_2$ is 11.5 seconds, the wire, upon emergence from this zone $Z_2$, having a temperature of about 630°C.

The time of passage in the zone $Z_3$ is 8.5 seconds, the pearlitization being completed upon the emergence from this zone $Z_3$. Within this zone $Z_3$, upon the pearlitization, the difference in temperature between the minimum temperature and the maximum temperature of the wire is 60° C., that is to say the recalescence is less than in the preceding Example 10, as a result of low rate of pearlitization in the zone $Z_3$, which is due to a higher transformation temperature.

After heat treatment, the wire has a tensile strength of 1010 MPa. The wire is then brass coated and then drawn in known manner to a diameter of 0.42 mm and it then has a tensile strength equal to 2500 MPa for a ratio of the cross sections of 44.44.

This example, which is not in accord with the invention, results in a very long time of treatment and a low tensile strength.

The structure of the wire after the heat treatment described in this example follows the relationship:

$$i+e=1450 \text{ Å (mean value)}$$

the standard deviation being 300 Å, that is to say the structure of the wire is not in accord with the structure previously described.

The invention is, of course, not limited to the embodiments which have been described above.

We claim:

1. A method of heat-treating a wire of carbon steel so as to obtain a fine pearlitic structure, the wire having been maintained, prior to this heat-treating, at a temperature above the Ac3 transformation temperature so as to obtain a homogeneous austenite, comprising the steps of: (a) cooling the wire from a temperature greater than the Ac3 transformation temperature to a temperature less than the Ac1 transformation temperature and (b) effecting pearlitization at a temperature below the Ac1 transformation temperature, said steps (a) and (b) being carried out by passing the wire through at least one tube which contains a gas practically without forced ventilation, and which is surrounded by a heat-exchange fluid such that a transfer of heat takes place from the wire through the gas and through the tube to the heat-exchange fluid, and the characteristics of the tube, the wire and the gas being selected such that the following relations are satisfied in at least said step (a):

$$1.05 \leqq R \leqq 15 \quad (1)$$

$$5 \leqq K \leqq 10 \quad (2)$$

in which $$R = D_{ti}/D_f$$

$$K = [Log\ (D_{ti}/D_f)] \times D_f^2/\lambda$$

$D_{ti}$ being the inside diameter of the tube expressed in millimeters, $D_f$ being the diameter of the wire expressed in millimeters, this diameter being not greater than 6 mm, $\lambda$ being the conductivity of the gas determined at 600° C., expressed in watts.$m^{-1}.^{o}K^{-1}$, and Log being the natural log.

2. A method according to claim 1, wherein after having cooled the wire from a temperature above the Ac3 transformation temperature to a given temperature below the Ac1 transformation temperature, the wire is held within a range of 10° C. plus or minus from said given temperature for a period of time greater than the pearlitization time by modulating the heat exchanges, the following relations being followed in a zone or zones of the tube or tubes in which the rate of pearlitization is fastest:

$$1.05 \leqq R \leqq 8 \quad (3)$$

$$3 \leqq K \leqq 8 \quad (4).$$

3. A method according to claim 2, wherein the wire is held within a range of temperatures of not more than 5° C. plus or minus from said given temperature.

4. A method according to either of claims 2 and 3, wherein the modulation is effected by varying the inside diameter of the tube or of at least one tube.

5. A method according to any either of claims 2 and 3, wherein the modulation is effected by using at least two tubes, the lengths of which are different.

6. Apparatus for heat-treating a wire of carbon steel so as to obtain a fine pearlitic structure, the wire having been held, prior to this heat-treating, at a temperature above the Ac3 transformation temperature so as to obtain a homogeneous austenite, comprising: (a) means for cooling the wire from a temperature above the Ac3 transformation temperature to a temperature below the Ac1 transformation temperature; and (b) means for effecting pearlitization of the wire at a temperature below the Ac1 transformation temperature; said cooling and pearlitization means including at least one tube, means for moving the wire through the tube, a gas contained in the tube which is practically without forced ventilation, and a heat-exchange fluid surrounding the tube in such a manner that a transfer of heat takes place from the wire through the gas and through the tube to the heat-exchange fluid, the characteristics of the tube, the wire and the gas being so selected that the following relations are satisfied in at least said cooling means:

$$1.05 \leqq R \leqq 15 \quad (1)$$

$$5 \leqq K \leqq 10 \quad (2)$$

in which $$R = D_{ti}/D_f$$

$$K = [Log\ (D_{ti}/D_f)] \times D_f^2/\lambda$$

$D_{ti}$ being the inside diameter of the tube expressed in millimeters, $D_f$ being the diameter of the wire expressed in millimeters, this diameter being not greater than 6 mm, $\lambda$ being the conductivity of the gas determined at 600° C. and expressed in watts.$m^{-1}.^{o}K^{-1}$, and Log being the natural log.

7. A device according to claim 6, wherein the tube or tubes of the pearlitization means are dimensioned such that they afford maintaining the wire at a range of temperatures within 10° C. plus or minus from a given temperature below the Ac1 transformation temperature for a period of time greater than the pearlitization time by modulating the heat exchanges, the following relationships being satisfied in a zone or zones of the tube or tubes in which the pearlitization rate is fastest:

$$1.05 \leqq R \leqq 8 \quad (3)$$

$$3 \leqq K \leqq 8 \quad (4).$$

8. A device according to claim 7, wherein the tube or tubes of the pearlitization means are dimensioned such that the temperature of the wire does not differ by more than 5° C. plus or minus from said given temperature.

9. A device according to either of claims 7 and 8, wherein the inside diameter of the tube or of at least one tube varies.

10. A device according to either of claims 7 and 8, wherein the pearlitization means includes at least two tubes, the lengths of which are different.

* * * * *

UNITED STATES PATENT AND TRADEMARK OFFICE

CERTIFICATE OF CORRECTION

PATENT NO. : 4,983,227

DATED : Jan. 8, 1991

INVENTOR(S) : Reiniche et al.

It is certified that error appears in the above-identified patent and that said Letters Patent is hereby corrected as shown below:

Col. 1, line 57, "of tne" should read --of the--. Col. 3, line 35, "device" should read --devices--. Col. 4, line 49, "the say" should read --to say--. Col. 5, line 12, "wire 7" should read --wire 1--; line 62, "than" should read --then--. Col. 6, line 17, "K=[Log $(D_{ti}/D_f)$] x $D_f2$" should read --K=[Log $(D_{ti}/D_f)$] x $D_f2/\lambda$--; delete line 19 ($R=D_{ti}/D_f/\lambda$); line 56, "forming" should read --forming the--. Col. 7, line 4, "this" should read --on this--. Col. 8, line 49, "wire" should read --wire 1--. Col. 9, line 18, "is" should read --is cooled--; line 19, "The then" should read --The wire then--; line 51, "tube" should read --tubes--. Col. 10, line 9, "installation" should read --installation 500--; line 58, "0.25 mm" should read --25 mm--; line 60, "$D_{te}10$" should read --$D_{te}$ = 10--. Col. 11, line 1, "Lm" should read --$L_m$--. Col. 12, line 27, "0.20 mm" should read --0.20 m--; line 48, "Zone $Z_3$" should read --Zone $Z_3$:--. Col. 14, line 57, "14.8 m" should read --14.85 m--; last line, "0.42R" should read 0.42; R--. Col. 15, line 42, "0.25 mm" should read --25 mm--. Col. 17, line 10, after "R = $D_{ti}/D_f$" insert --and--;

UNITED STATES PATENT AND TRADEMARK OFFICE

CERTIFICATE OF CORRECTION

PATENT NO. : 4,983,227

DATED : Jan. 8, 1991

INVENTOR(S) : Reiniche et al.

It is certified that error appears in the above-identified patent and that said Letters Patent is hereby corrected as shown below:

Col. 17, line 39, "any either" should read --either--.

Col. 18, line 17, after "$R = D_{ti}/D_f$" insert --and--.

Signed and Sealed this

Twenty-seventh Day of October, 1992

*Attest:*

DOUGLAS B. COMER

*Attesting Officer*

*Acting Commissioner of Patents and Trademarks*